US008278580B2

(12) United States Patent
Zieder

(10) Patent No.: US 8,278,580 B2
(45) Date of Patent: Oct. 2, 2012

(54) DOME SWITCH UTILIZING TWO DOMES

(75) Inventor: David Zieder, Sciez (FR)

(73) Assignee: Nicomatic SA, Bons en Chablais (FR)

( * ) Notice: Subject to any disclaimer, the term of this patent is extended or adjusted under 35 U.S.C. 154(b) by 289 days.

(21) Appl. No.: 12/531,175

(22) PCT Filed: Mar. 11, 2008

(86) PCT No.: PCT/FR2008/050408

§ 371 (c)(1),
(2), (4) Date: Feb. 2, 2010

(87) PCT Pub. No.: WO2008/129193

PCT Pub. Date: Oct. 30, 2008

(65) Prior Publication Data

US 2010/0140072 A1 Jun. 10, 2010

(30) Foreign Application Priority Data

Mar. 14, 2007 (FR) ..... 07 01848

(51) Int. Cl.
*H01H 5/18* (2006.01)

(52) U.S. Cl. ..... 200/406

(58) Field of Classification Search ..... 200/406, 200/512, 516, 517

See application file for complete search history.

(56) References Cited

U.S. PATENT DOCUMENTS

| | | | | |
|---|---|---|---|---|
| 5,898,147 | A * | 4/1999 | Domzalski et al. | 200/1 B |
| 6,603,086 | B2 * | 8/2003 | Kawaguchi et al. | 200/517 |
| 6,858,811 | B2 * | 2/2005 | Fitzgerald et al. | 200/85 R |
| 2003/0173201 | A1 * | 9/2003 | Ohashi | 200/517 |

FOREIGN PATENT DOCUMENTS

| | | | |
|---|---|---|---|
| EP | 0 758 790 | A2 | 2/1997 |
| EP | 1 670 012 | A2 | 6/2006 |
| WO | WO 2005/045867 | A1 | 5/2005 |

OTHER PUBLICATIONS

PCT Search Report of the ISA for PCT/FR2008/050408 dated Oct. 22, 2008.

* cited by examiner

*Primary Examiner* — Vanessa Girardi

(74) *Attorney, Agent, or Firm* — Daly, Crowley, Mofford & Durkee, LLP

(57) ABSTRACT

The invention concerns a multi-domed switch. It relates to a multi-domed switch of the push-button type for thin printed circuit possessing a thin substrate (20) against one face of which a printed circuit having connection pads is placed. The switch comprises two domes (12) and an insulating spacer, the peripheral parts of the two domes (12) are each in contact with one face of the spacer and are thus facing each other on either side of the spacer, each dome (12) possesses a connection member (18) for connection to a connection pad of the printed circuit (20), and the spacer has a central hole large enough for the tops of the two domes (12) to be able to come into mutual contact when they are subjected to a closing-off force. Application to chip cards.

9 Claims, 2 Drawing Sheets

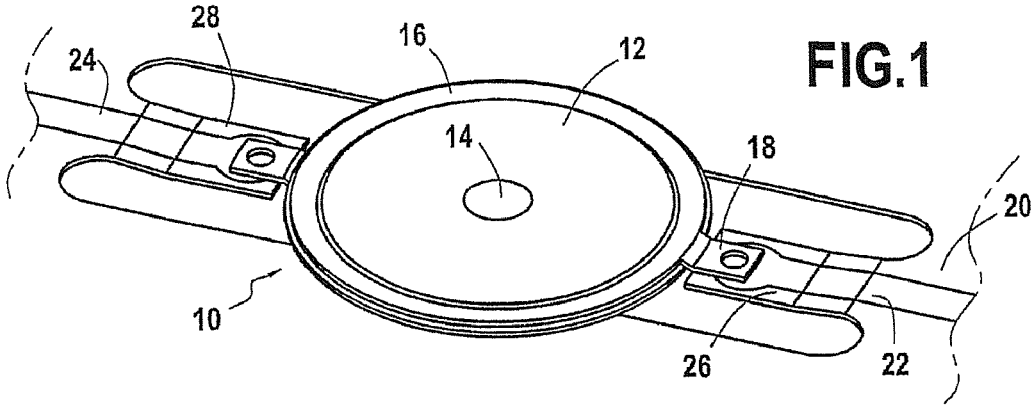
FIG.1
FIG.2
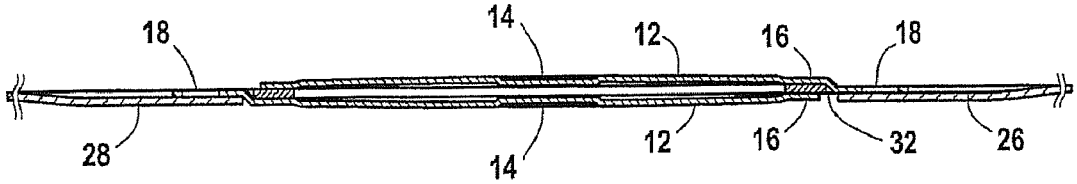
FIG.3
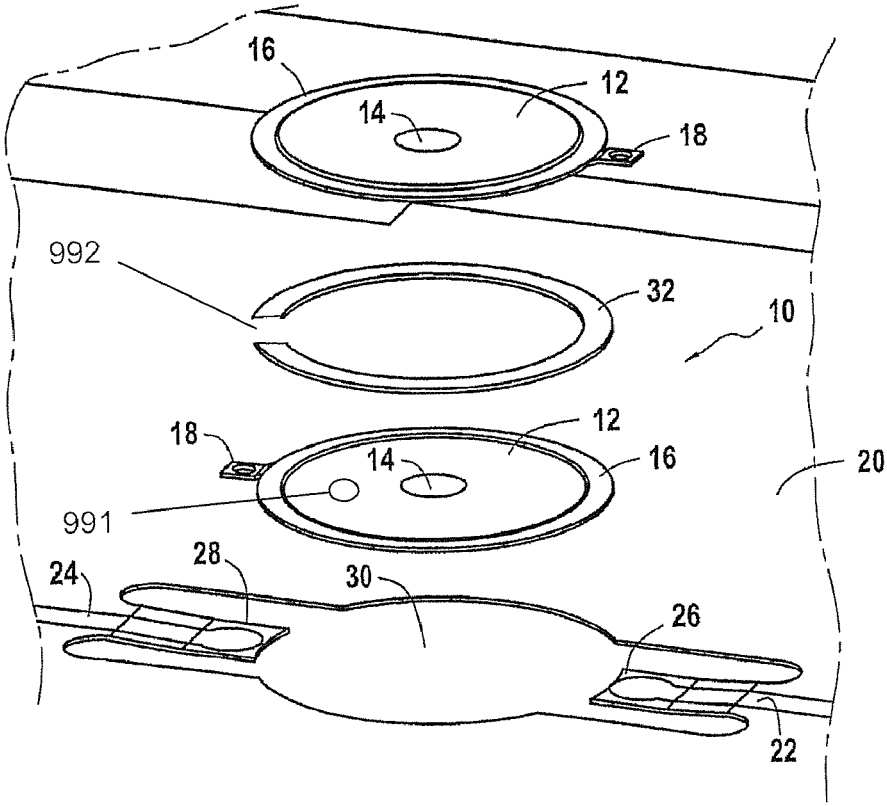

DOME SWITCH UTILIZING TWO DOMES

CROSS REFERENCE TO RELATED APPLICATIONS

This application is a National Stage application of PCT/FR2008/050408 filed on Mar. 11, 2008, and entitled "Pusher-Type Vault Switch and Printed Circuit Including Same," which claims priority to French application FR0701848 filed on Mar. 14, 2007.

BACKGROUND OF THE INVENTION

1. Field of the Invention

The present invention relates to a multi-domed switch of the push-button type for a thin printed circuit and to a thin printed circuit. Such a thin printed circuit may be incorporated into a chip card (also called a smart card).

2. Description of Related Art

Contact members called "domes" are frequently used as elements of a push-button switch in a keyboard. A dome is an element in the form of a spherical cap, the cap either being continuous or peripherally notched, which exerts a force in reaction to a pressure that varies as shown in FIG. 6.

The curves in FIG. 6 show, plotted on the y-axis, the variation in the force applied at the centre of a dome as a function of the travel (plotted on the x-axis) of this central part of the dome. The upper curve corresponds to the increase in pressure applied to the dome, into its contact position, and the lower curve corresponds to the relaxing of this pressure, into the rest state. The upper curve shows that the necessary force increases up to a maximum $F_t$ for a travel of $T_t$ before rapidly decreasing down to a smaller value $F_r$ for a travel $T_r$ before a slight rise in the force until complete contact.

The part of this curve in which the force decreases while the travel between the travels $T_t$ et $T_r$ increases gives a tactile effect felt by the finger exerting a pressure on the dome. The first part of the travel may be as gradual as desired, by applying a force that increases slowly. However, once the maximum force $F_t$ is reached, the transition to straight contact takes place very rapidly through the action of the elasticity of the dome itself.

It is desirable to use such domes in push-button switches incorporated into thin circuits. The advantage of these push-button switches is that they allow the formation of "keyboard" or control keys incorporated into thin members. Thus, to produce relatively flexible chip cards provided with a keyboard and with a display, it is desirable to use contact domes for push-button switches.

It has therefore been attempted to incorporate domes of various shapes into such chip cards. Owing to the dimensional constraints of these cards, the domes must have a diameter of about 5 to 8 mm in the plane of the card and a travel of few tenths of a millimeter, namely less than 0.45 mm. No construction of a domed push-button switch has been satisfactory in this application. The reasons for this are in general either the absence of a discernible tactile reaction or more often insufficient reliability.

BRIEF SUMMARY OF THE INVENTION

The object of the invention is to produce such domed push-button switches that given an effective tactile reaction while still being very reliable, i.e. ensuring that a certain contact is obtained for a number of operations much larger than that which can normally be envisaged in the case of such a card.

According to the invention, this result is achieved by using two approximately identical domes placed one against the other via their periphery with a spacer interposed therebetween. Although this arrangement reduces the travel that each dome can undertake, it has been found, surprisingly, on the one hand, that a very significant tactile effect is obtained and, on the other hand, that the reliability is high, doubtless because, thanks to the arrangement with the two domes facing each other, the forces that are applied to them are entirely accommodated by the domes and do not create significant stresses in the material of the printed circuit of the card that surrounds them.

More precisely, the invention relates to a multi-domed switch of the push-button type for a thin printed circuit possessing a thin substrate against at least one face of which a printed circuit having at least two connection pads to be connected by the switch is placed. According to the invention, the switch comprises two domes and an insulating spacer, the peripheral parts of the two domes are each in contact with one face of the spacer and are thus facing one another on either side of the spacer, each dome possesses a connection member intended to be permanently connected to a connection pad of the printed circuit, and the spacer has a central hole large enough for the tops of the two domes to be able to come into mutual contact when they are subjected to a closing-up force.

In one embodiment, the domes take the form of a spherical cap having a continuous or practically continuous circular periphery.

In this case, the connection member of each dome is preferably a lug that extends beyond the spherical cap and which has, for example, a through-hole for soldering. Preferably, the connection members of the two domes are therefore in offset positions along the periphery of the switch.

In a variant, the spacer is continuous all around the periphery, and at least one of the domes has a hole for bringing the two sides of the dome into communication and/or the spacer is discontinuous at least at one position on its periphery.

In another variant, the spacer is continuous all around the periphery, and the closed space lying between the domes is, in the open position of the switch, at a different pressure from the ambient pressure outside the domes.

In another embodiment, the domes have a central part from which at least three branches extend, the two domes having practically identical dimensions, the external ends of the branches of one dome being in contact with the spacer in positions in which they are facing the external ends of the branches of the other dome.

In this case, the spacer is preferably discontinuous and is present only between the ends of the branches.

Preferably, the domes are fixed to the spacer by adhesive bonding. For example, the spacer is entirely formed from an adhesive.

The invention also relates to a thin printed circuit, of the type which comprises a thin substrate against at least one face of which a printed circuit having at least two connection pads connected by a switch of the push-button type is placed. According to the invention, the thin substrate has an orifice between the two connection pads, and the push-button switch is according to any one of the preceding paragraphs and is placed so that the tops of the domes are practically centred on the orifice.

In one embodiment, the orifice of the substrate has dimensions at least equal to those of the periphery of the dome, and the connection member of the dome extends towards a connection pad.

In another embodiment, the orifice has dimensions at last substantially equal to those of the periphery of the dome, and parts of the thin substrate having the connection pads extend into the orifice in order to be connected to the domes.

In another embodiment, the orifice has smaller dimensions those of the periphery of the dome, so that the thin substrate constitutes the spacer.

In a variant, the printed circuit is integrated into a laminated assembly comprising, in addition to the thin substrate, a protective layer placed on at least one of the faces of the thin substrate.

In another variant, the printed circuit is integrated into a laminated assembly comprising, at the two faces of the thin substrate, protective layers which completely surround the switch, and may be flexible or rigid.

Preferably, the printed circuit is incorporated into a chip card.

One of the advantages of the push-button switches according to the invention is that they constitute components that can be manipulated and put into place by the usual pick-and-place machines for electrical and electronic components.

BRIEF DESCRIPTION OF THE SEVERAL VIEW OF THE DRAWING(S)

Other features and advantages of the invention will be better understood on reading the following description of an exemplary embodiment, with reference to the appended drawings in which:

FIG. 1 is a greatly enlarged perspective view of part of a thin printed circuit provided with a push-button switch according to the invention;

FIG. 2 is a diametral section of the push-button switch of FIG. 1, with adjacent parts of the printed circuit;

FIG. 3 is similar to FIG. 1 but shows, in exploded form, the various elements of the push-button switch;

DETAILED DESCRIPTION OF THE INVENTION

Figure 4:
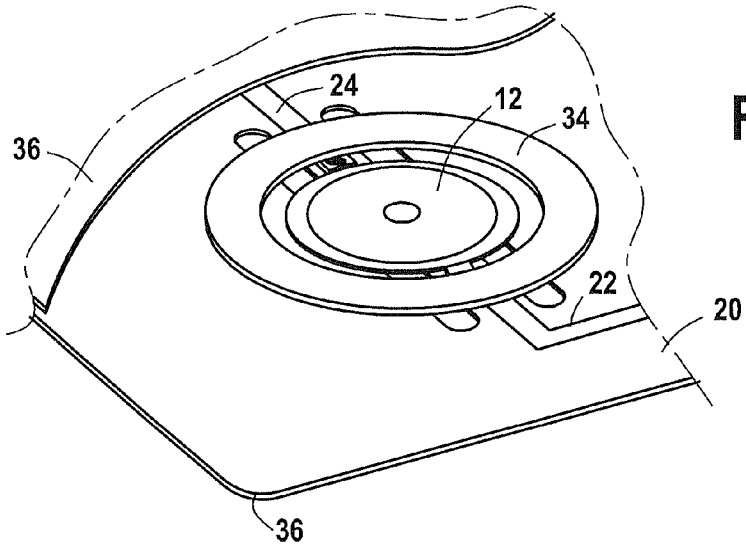
FIG. 4 is a perspective view of part of a chip card comprising the push-button switch of FIGS. 1 to 3.

FIG. 1 is a perspective view of a push-button switch according to the invention incorporated into a thin printed circuit, for example a relatively flexible chip card.

The push-button switch 10, shown in cross section in FIG. 2 and in exploded form in FIG. 3, comprises two domes 12 having a slight convexity 14 at the centre and a continuous circular peripheral part 16. Each dome 12 has a lug 18 that extends beyond this periphery and preferably has a hole for optionally accommodating solder.

FIGS. 2 and 3 indicate that a circular spacer 32 is placed between the two domes.

The push-button switch 10 is placed on a printed circuit 20, which is thin, owing to its small thickness (of the order of one tenth of a millimeter), and is relatively flexible. This printed circuit 20 has tracks 22, 24 that form connection pads on tabs 26, 28 placed around a central orifice 30 of circular shape.

In this embodiment, and as the cross section in FIG. 2 indicates, each lug 18 forming a connection member of a dome 12 is in contact with one of the two pads of the tracks 22, 24 printed on the tabs 26, 28 of the thin substrate 20.

Since the spacer 32 is insulating, the domes are in electrical contact only when pressure is exerted by pinching the domes of the switch so as to bring the convexities 14 at the tops of the domes closer together.

In this embodiment, the diameter of each dome (considered without the lug 18) is for example 8 mm, although domes of 5 or 6 mm in diameter can also be used. Preferably, the metal is steel with a thickness of a few tens of microns. The total thickness of the switch, i.e. that of the two domes and the spacer, is around 0.4 to 0.45 mm. The travel between the open position in which the convexities 14 are apart and the closure position obtained by these convexities contacting each other is around 0.3 mm.

Figure 5:
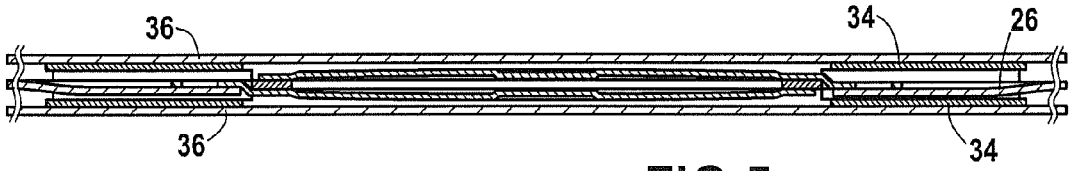
FIG. 5 is a section of the printed-circuit part of a chip card shown in FIG. 4.

The way in which such a push-button switch is incorporated into a thin printed circuit will now be considered with reference to FIGS. 4 and 5. The push-button switch, shown in the form of a dome 12, is surrounded on each face of the printed circuit 20 by a guard ring 34 which is placed around the domes and is clear of the latter, but it covers the connection parts between the lugs or connection members of the domes and the tracks of the printed circuit 20. A protective layer 36 is placed on each side of the substrate 20, above the spacer 32, so that the switch is entirely enclosed, as indicated in FIG. 5. Since the protective layers are flexible, the switch can be easily controlled by pinching it between two fingers.

In the exemplary embodiment shown in FIGS. 1 to 5, a push-button switch formed with domes 8 mm in diameter has operated several tens of thousand times. It can be used over a very wide temperature range, being controlled by a low activation force of around 2 to 3.5 N. This force is easily applied by pressing between two fingers.

Although a spacer 32 has been shown in FIG. 3 in the form of a separate element, it may simply consist of a ring of insulating adhesive placed between the two domes, with a thickness just sufficient to provide insulation.

Figure 6:
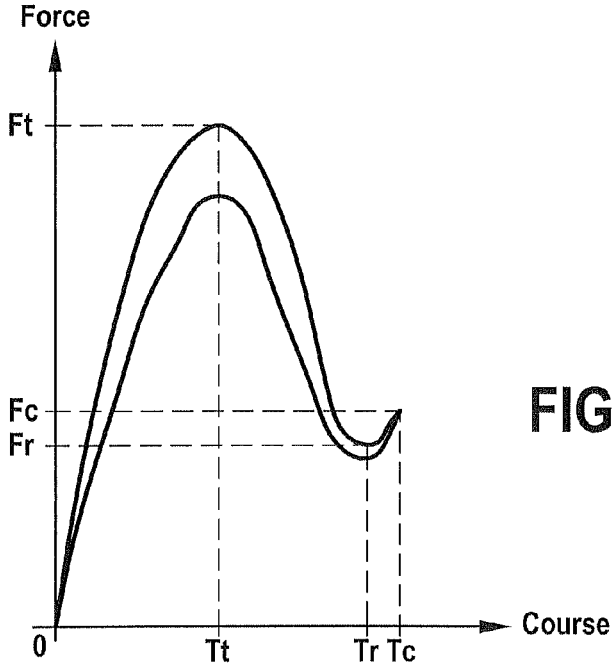
FIG. 6, already described, is a graph indicating the variation in the force applied to a conventional dome as a function of the travel.

In the embodiment shown in FIGS. 1 to 5, the space bounded on the inside of the switch, between the domes and the spacer, is brought into connection with the space external to the dome, either via a hole 991 formed in at least one dome or by at least one linking channel 992 formed in the spacer 32, preferably in a direction inclined to the radial direction. In this way, the domes of the push-button switch behave in the conventional manner described above with reference to FIG. 6.

In variants, it is possible to produce a push-button switch with no communication between the internal space and the external space. For example, the switch may be produced in a vacuum, so that its behaviour is not that indicated in FIG. 6 but corresponds to a curve starting above the x-axis. However, in order for the domes not to remain stuck together after having been brought into contact, i.e. in order for the vacuum not to be sufficient to prevent the two domes from separating, it is necessary for the force created by this vacuum to be sufficiently below that corresponding to the force $F_r$. Thus, the advantage of reducing the travel, and therefore reducing the thickness of the switch, can be obtained only if the force due to the vacuum does not reach the value of the trough of the curves shown in FIG. 6 for the travel $T_r$.

In another variant, the space lying between the domes contains air or a gas at atmospheric pressure or at a higher pressure, and it is not connected to the outside. Thus, when closing the switch, compression of the gas placed inside increases the necessary compressive force. However, the shape of the domes must be such that, in the closure position, the space remaining between the two domes is sufficient for the observed minimum in the curve for the travel $T_r$ to remain below the observed maximum of the curve for the travel $T_t$; otherwise, the tactile effect given by the reduction in force upon increasing the travel would be lost.

Although a push-button switch comprising two domes in the form of spherical caps has been described, it is also possible to use domes having a circular central part and branches that extend beyond it, i.e. star-shaped domes having at least three branches. In this case, the domes must have practically identical dimensions so that the lugs can be facing one another on either side of the spacer. The latter is then preferably discontinuous.

Although the application of the invention to a chip card has been described, it is suitable for other applications such as flexible connection strips, for example of the type called "ribbon cables", when they have to incorporate a push-button switch function.

The invention claimed is:

1. A switch for use with a substrate having a printed circuit provided on at least one face thereof with the printed circuit having at least two connection pads to be connected by the switch, the switch comprising:

at least two domes, wherein each of said at least two domes take the form of a spherical cap having a continuous or substantially continuous circular periphery provided with a lug which projects from the periphery of said spherical cap, wherein said lug is configured to be permanently connected to at least one of the connection pads of the printed circuit; and an insulating spacer having first and second opposing faces with the periphery of at least two of said at least two domes in contact with one face of said insulating spacer such that the periphery are facing one another on either side of said insulating spacer wherein said insulating spacer has a central hole large enough for tops of the at least two domes to be able to come into mutual contact when they are subjected to a closing-up force.

2. The switch according to claim 1 wherein said insulating spacer is continuous all around the periphery, and at least one of said at least two domes has a hole for bringing the space bounded on the inside of the switch, between said at least two domes and said insulating spacer, into communication with the space outside the domes.

3. The switch according claim 1 wherein said insulating spacer comprises a linking channel for bringing the space bounded on the inside of the switch, between said at least two domes and said insulating spacer, into communication with the space outside the domes.

4. The switch according to claim 1 wherein said insulating spacer is continuous all around the periphery, and the closed space lying between said at least two domes is, in the open position of the switch, at a different pressure from the ambient pressure outside said at least two domes.

5. The switch according to claim 1 wherein said at least two domes are fixed to said insulating spacer by adhesive bonding.

6. A circuit comprising:

a substrate having at least one face and having an orifice;

a printed circuit provided on at least one of said at least one faces, said printed circuit having at least two connection pads on at least one of said at least one faces, with the orifice of said substrate disposed between the two connection pads; and a switch disposed to connect at least two of the at least two connection pads provided on said substrate, said switch having two domes disposed such that top portions of said two domes are substantially centered on the orifice, wherein said two domes each take the form of a spherical cap having a continuous or substantially continuous circular periphery and said periphery is provided with a lug which projects from the periphery of said spherical cap, wherein said lug is configured to be permanently connected to at least one of the connection pads of the printed circuit.

7. The circuit according to claim 6 wherein the orifice of said substrate has dimensions at least equal to those of the periphery of the dome, and a connection member of at least one of said domes extends towards a connection pad.

8. The circuit according to claim 6 wherein said printed circuit is provided as a laminated assembly comprising, at the two faces of said substrate, protective layers disposed about said switch.

9. The circuit according to claim 6 wherein said switch is provided as a push-button type switch.

* * * * *